US007328780B2

(12) United States Patent
Hawthorne

(10) Patent No.: US 7,328,780 B2
(45) Date of Patent: Feb. 12, 2008

(54) DEVICE FOR HOLDING AND DRYING SPORTS APPAREL

(76) Inventor: Robert T. C. Hawthorne, 34 Maple Ridge Drive, RR 2, Omemee, Ontario (CA) K0L ZWO ( * ) Notice: Subject to any disclaimer, the term of this patent is extended or adjusted under 35 U.S.C. 154(b) by 261 days.

(21) Appl. No.: 11/212,784

(22) Filed: Mar. 9, 2005

(65) Prior Publication Data

US 2006/0042976 A1 Mar. 2, 2006

Related U.S. Application Data

(60) Provisional application No. 60/551,903, filed on Mar. 11, 2004.

(51) Int. Cl.
*A45C 7/00* (2006.01)

(52) U.S. Cl. ..... 190/107; 190/109; 190/901; 206/315.1; 383/38; 383/117

(58) Field of Classification Search ..... 383/38, 383/39, 117; 206/278, 315.1, 287, 287.1; 189/107, 109, 901; 190/107, 109, 901
See application file for complete search history.

(56) References Cited

U.S. PATENT DOCUMENTS

D140,519 S * 3/1945 Pascal ..... D6/320
4,164,968 A * 8/1979 Esposito et al. ..... 224/607
4,883,207 A * 11/1989 McArthur ..... 224/153
4,953,765 A * 9/1990 Little et al. ..... 224/583
4,960,204 A * 10/1990 Young et al. ..... 206/235
5,413,199 A 5/1995 Clement
5,447,216 A * 9/1995 Freyvogel ..... 190/18 A
5,743,649 A * 4/1998 Gonzalez ..... 383/6
5,779,033 A * 7/1998 Roegner ..... 206/6.1
5,845,780 A * 12/1998 Allen ..... 206/579
6,193,034 B1 2/2001 Fournier
6,250,470 B1 * 6/2001 Mackenzie ..... 206/579
6,276,501 B1 * 8/2001 Tong ..... 190/107
6,371,645 B1 4/2002 Rusert et al.
6,948,599 B2 9/2005 Rodrigue et al.
2002/0074199 A1 * 6/2002 Albritton ..... 190/107
2004/0050638 A1 3/2004 Rodrigue et al.
2005/0232519 A1 * 10/2005 Grimes ..... 383/39

* cited by examiner

*Primary Examiner*—Sue A. Weaver
(74) *Attorney, Agent, or Firm*—Thomas A. O'Rourke; Bodner & O'Rourke, LLP

(57) ABSTRACT

A device for holding and drying apparel includes a foldable panel being convertible between an unfolded open arrangement or a folded closed arrangement, said foldable panel having at least one compartment disposed therefrom for receiving at least one item of said apparel, said foldable panel and compartment further including a series of open drying spaces for exposing said apparel to ambient air flow for drying thereof, and at least one support portion for carrying and/or hanging said apparel therefrom.

6 Claims, 9 Drawing Sheets

DEVICE FOR HOLDING AND DRYING SPORTS APPAREL

REFERENCE TO CO-PENDING APPLICATION

The entire subject matter of U.S. Provisional application Ser. No. 60/551,903 filed Mar. 11, 2004 and entitled HOCKEY EQUIPMENT ORGANIZER AND DRYING SYSTEM is incorporated by reference. The applicant claims priority benefit under Title 35, United States Code, Section 119(e) of U.S. Provisional application Ser. No. 60/551,903 filed Mar. 11, 2004 and entitled HOCKEY EQUIPMENT ORGANIZER AND DRYING SYSTEM.

TECHNICAL FIELD

The invention relates to the apparel and more specifically to sports apparel and handling, storing and/or conditioning thereof between sports events.

BACKGROUND ART

It is common to carry sports apparel, such as sports equipment, in a dunnage bag between sporting events. The athlete then must contend with transporting the equipment to a temporary storage location, such as a home storage room or the like, between games. Sometimes the athlete may actually remove the equipment from the dunnage bag and hang it to dry. Other times the athlete will simply leave the equipment wet in the dunnage bag and the outcome is not very pleasant either for the athlete or those who play with him.

There remains a need to improve the ease of handling of apparel such as sports apparel.

SUMMARY OF THE INVENTION

Briefly stated, the invention involves a device for holding and drying apparel comprising a foldable panel being convertible between an unfolded open arrangement or a folded closed arrangement, said foldable panel having at least one compartment disposed therefrom for receiving at least one item of said apparel, said foldable panel and compartment further including a series of open drying spaces for exposing said apparel to ambient air flow for drying thereof, and at least one support portion for carrying and/or hanging said apparel therefrom.

In an embodiment, the foldable panel further includes at least one fastener to secure said at least one item of apparel when the foldable panel is in said folded closed arrangement. In one example, the at least one fastener includes Velcro®. Alternatively or in combination, the at least one fastener includes a retractable opening to said at least one compartment.

In an embodiment, the at least one item of apparel further includes at least one item of sports equipment.

In an embodiment, the at least one compartment further comprises one or more of a pair of compartments to receive a hand glove, a compartment to receive a helmet, a compartment to receive a set of shoulder pads, a pair of compartments to receive a shin pad, a pair of compartments to receive a foot wear item, a compartment to receive a pair of athletic pants or shorts, a pair of compartments to receive an elbow pad and one or more compartments to receive sport accessories.

In an embodiment, the at least one item of sports equipment includes an item of ice-hockey equipment.

In an embodiment, the at least one compartment further comprises one or more of a pair of compartments to receive a hockey glove, a compartment to receive a helmet, a compartment to receive a set of shoulder pads, a pair of compartments to receive a shin pad, a pair of compartments to receive a skate, a compartment to receive a pair of hockey pants, and a pair of compartments to receive an elbow pad and one or more compartments to receive hockey accessories.

In another of its aspects, there is provided a method for conditioning at least one item of sports apparel between sports activities comprising the steps of:

- providing a foldable panel in an unfolded open orientation;
- suspending the foldable panel at a sports venue;
- providing at least one compartment on the foldable panel;
- providing the compartment with an inner cavity for receiving at least one item of sports apparel therein;
- providing the compartment with a sufficient number of air exchange passages for ambient air or cleaning fluid transfer therethrough when the support panel is in at least one conditioning orientation;
- placing at least one item of unconditioned sports apparel in the at least one compartment after a sports event; and
- retaining the foldable panel in the conditioning orientation for a sufficient period of time to condition the at least one item of sports apparel.

In one embodiment, the method further comprises the step of providing at least one support for supporting the foldable panel in the conditioning orientation.

In one embodiment, the foldable panel is operable in a folded orientation, further comprising the step of providing at least one support for carrying the foldable panel in the folded orientation.

In one embodiment, the method further comprises, after the placing step, the steps of:

- carrying the device to another location; and
- arranging the foldable panel in the conditioning orientation.

In one embodiment, the foldable panel is unfolded in the conditioning orientation.

In one embodiment, the unconditioned sports apparel is wet and/or soiled.

In one embodiment, the method further comprises, following the retaining step, the step of depositing the device in a washing machine.

In one embodiment, the method further comprises, following the retaining step, the step of exposing the compartment to ambient air.

In one embodiment, the step of providing at least one compartment further comprises the step of providing a sufficient number of compartments to store all the sports apparel used by an athlete for a predetermined sports activity.

In one embodiment, the step of providing a sufficient number of compartments includes providing one or more of a pair of compartments to receive a hand glove, a compartment to receive a helmet, a compartment to receive a set of shoulder pads, a pair of compartments to receive a shin pad, a pair of compartments to receive a foot wear item, a compartment to receive a pair of athletic pants or shorts, a pair of compartments to receive an elbow pad and one or more compartments to receive sport accessories.

In one embodiment, the step of providing a sufficient number of compartments includes providing one or more of a pair of compartments to receive a hockey glove, a compartment to receive a helmet, a compartment to receive a set of shoulder pads, a pair of compartments to receive a shin pad, a pair of compartments to receive a skate, a compartment to receive a pair of hockey pants, and a par of compartments to receive an elbow pad and one or more compartments to receive hockey accessories.

In one embodiment, the method further comprises the step of providing a number of support elements extending outwardly from the panel for supporting sports apparel therefrom.

In one embodiment, the step of providing a number of support elements extending outwardly from the panel includes the step of providing a number of support straps for supporting athletic socks.

In still another of its aspects, the present invention provides a device for holding and drying apparel comprising: a foldable panel being convertible between an unfolded open arrangement or a folded closed arrangement, said foldable panel having at least one compartment disposed therefrom for receiving at least one item of said apparel, said foldable panel and compartment further including a series of open drying spaces for exposing said apparel to ambient air flow for drying thereof, said apparel being organized in said at least one compartment, and at least one support portion for carrying and/or hanging said apparel therefrom.

In yet another of its aspects, the present invention provides a device for holding and drying apparel comprising: a foldable panel being convertible between an unfolded open arrangement or a folded closed arrangement, said foldable panel having at least one compartment disposed therefrom for receiving at least one item of said apparel, said foldable panel and compartment further including a series of open drying spaces for exposing said apparel to ambient air flow for drying thereof, said apparel being organized in said at least one compartment, and including at least one support portion for carrying and/or hanging said apparel therefrom, and an enclosure for receiving the foldable panel and said apparel organized in at least one compartment therein.

In another of its aspects, the present invention provides a device for holding and drying sports apparel comprising: a foldable panel being convertible between an unfolded open arrangement or a folded closed arrangement, the foldable panel having a plurality of storage locations for receiving articles of clothing and/or accessories for a participating in a sport, the foldable panel having a base portion providing a matrix of open drying spaces along substantially its entire length for exposing said apparel to ambient air flow for drying thereof, the base portion having a peripheral region, a peripheral support portion attached thereto along substantially the entire peripheral region, the base portion having a plurality of anchor portions for supporting the base portion in an upright configuration to provide the base portion with an upper region, a central region and a lower region, the upper region including a pair of first storage locations, each to receive an item of arm and/or hand sports gear, a second storage location between the first storage locations to receive an item of head gear, a third storage location adjacent the second storage location to receive an item of shoulder and/or upper body support gear, the central region including a pair of opposed fourth storage locations, each to receive to receive an item of arm support gear to support an arm or a portion thereof, a pair of opposed fifth storage locations, each to receive to receive an item of foot gear, a pair of sixth storage locations to receive an item of hip, waist and/or genital support gear, the lower region including at least one seventh storage location to receive an item of leg and/or knee support gear.

In yet another of its aspects, the present invention provides a device for holding and drying sports apparel comprising a foldable panel being convertible between an unfolded open arrangement or a folded closed arrangement, the foldable panel having a base portion with a peripheral region, a peripheral support portion attached thereto along substantially the entire peripheral region, the base portion having a plurality of anchor portions for supporting the base portion in an upright configuration to provide the base portion with an upper region, a central region and a lower region, the upper region including a pair of hand sports gear compartments, each to receive an item of hand sports gear, a head gear compartment between the hand sports gear compartments to receive an item of head gear, the upper region further including an upper arm sports gear storage location adjacent the head gear compartment to receive an item of upper arm sports gear; the upper arm sports gear storage location including a pair of first strap portions positioned adjacent the head gear compartment and a buckle arrangement operable to join the first strap portions together; the central region including a pair of lower arm sports gear compartments, each to receive an item of lower arm sports gear and a sports pant storage location to receive a pair of sports pants, the sports pant storage location including a pair of second strap portions and a buckle arrangement operable to join the second strap portions together; a pair of foot gear compartments, each to receive an item of foot sports gear, an athletic support compartment to receive an athletic support; the lower region including at least one compartment to receive a plurality of items of leg support gear, the base portion providing a matrix of open drying spaces along substantially its entire length and the compartments providing a matrix of open drying spaces for exposing the sports apparel to ambient air flow for drying thereof.

An embodiment further comprises a pair of outer sock support locations for supporting a pair of sport socks, each outer support location including a sock support loop anchored to a corresponding peripheral support portion.

In an embodiment, the foldable panel further includes an elongate support portion extending along a central region of the base portion and aligned with the first and second strap portions.

In an embodiment, the elongate support portion includes a central support strap which is secured to the first and second strap portions.

In an embodiment, the foldable panel includes a pair of upper corners and a pair of lower corners, the anchor portions including a pair of loop portions, each located at a corresponding upper corner for securing to a wall support member.

In an embodiment, the upper and lower corners further comprise mating attachment portions for joining one upper corner of the foldable panel with a corresponding lower corner.

In an embodiment, the attachment portions include buckle arrangements.

An embodiment further comprises a central loop portion integrally formed with the central support strap.

In yet another of its aspects, the present invention provides a method for storing sports apparel comprising the steps of:

providing a foldable panel which is convertible between an unfolded open arrangement or a folded closed arrangement, providing the foldable panel with a base portion having a peripheral region and attaching a peripheral support portion along substantially an entire length dimension of the peripheral region, providing the base portion with a plurality of anchor portions for supporting the base portion in an upright configuration to provide the base portion with an upper region, a central region and a lower region, providing, in the upper region, a pair of hand sports gear compartments to receive a corresponding pair of items of hand sports gear, a head gear compartment between the hand sports gear compartments to receive an item of head gear, and an upper arm sports gear storage location adjacent the head gear compartment to receive an item of upper arm sports gear, wherein the upper arm sports gear storage location includes a pair of first strap portions positioned adjacent the head gear compartment and a buckle arrangement operable to join the first strap portions together, providing, in the central region, a pair of lower arm sports gear compartments to receive a corresponding pair of items of lower arm sports gear and a sports pant storage location to receive a pair of sports pants, wherein the sports pant storage location includes a pair of second strap portions and a buckle arrangement operable to join the second strap portions together; and a pair of foot gear compartments, each to receive an item of foot sports gear, and an athletic support compartment to receive an athletic support, providing the lower region with at least one compartment to receive a plurality of items of leg support gear, and providing the base portion with a matrix of open drying spaces along substantially its entire length and the compartments with a matrix of open drying spaces for exposing the sports apparel to ambient air flow for drying thereof.

BRIEF DESCRIPTION OF THE DRAWINGS

Several preferred embodiments of the present invention will now be described, by way of example only, with reference to the appended drawings in which.

DETAILED DESCRIPTION OF THE PREFERRED EMBODIMENTS

Figure 1:
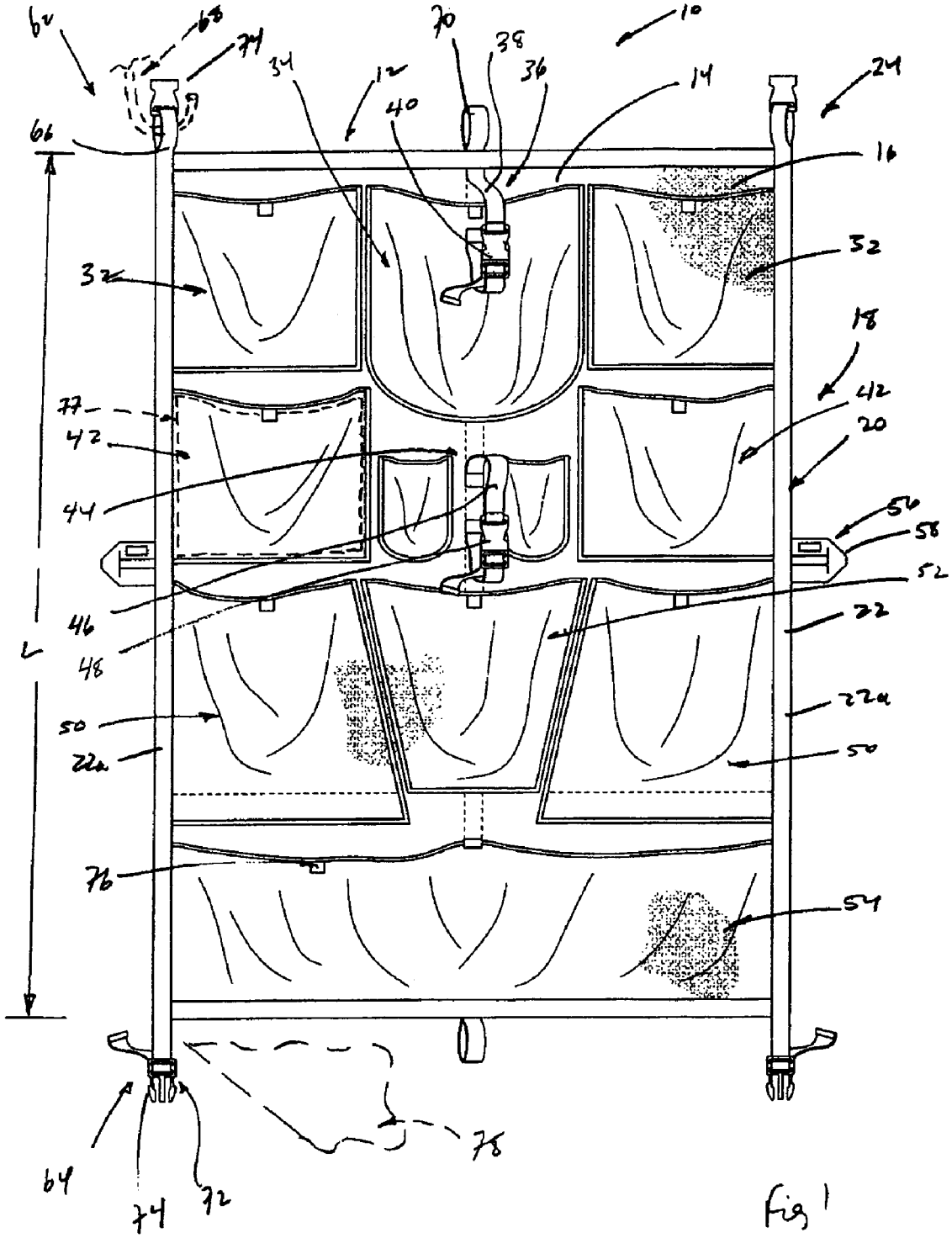
FIG. 1 is front view of a storage device.

FIGS. 1 to 4 show a device 10 for holding and drying sports apparel. The device has a foldable panel 12 which is convertible between an unfolded open arrangement and a folded closed arrangement. As will be described, the foldable panel 12 has a plurality of compartments and/or storage locations for receiving the sports apparel, which may include, for example, articles of clothing and/or accessories for a participating in a sport.

The foldable panel 12 has a base portion 14 providing a matrix of open drying spaces 16 along substantially its entire length L for exposing the apparel to ambient air flow for drying thereof. The base portion 14 has a peripheral region 18 and a peripheral support portion 20 attached thereto along substantially the entire peripheral region 18. In this case, the peripheral support portion 20 includes a strap member 22 with strap portions 22*a* which are stitched alongside and to the peripheral region 18.

Figure 2:
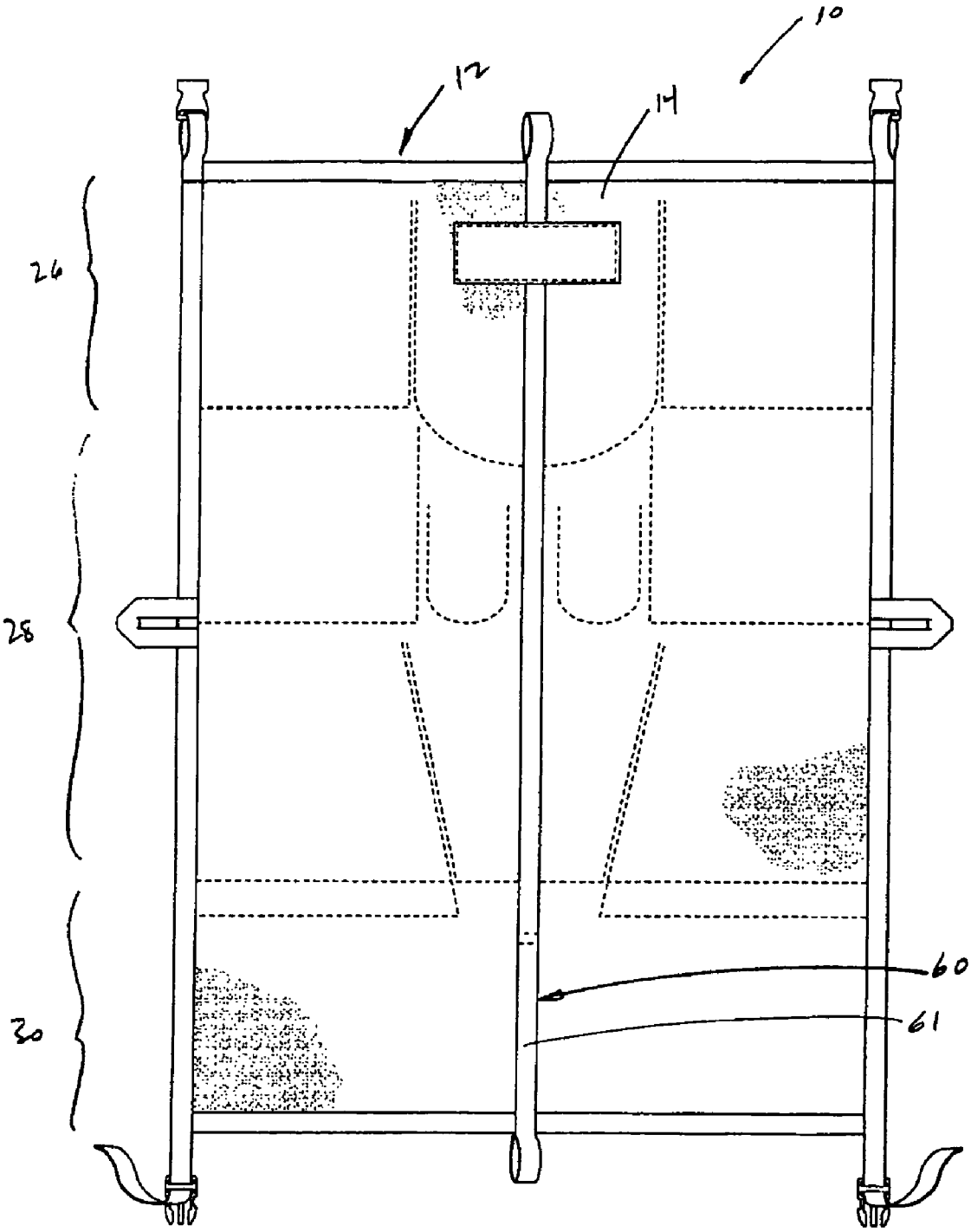
FIG. 2 is a rear view of the device of FIG. 1.

The base portion 14 has a plurality of anchor portions 24 for supporting the base portion 14 in an upright configuration to provide the base portion 14, as shown in FIG. 2, with an upper region 26, a central region 28 and a lower region 30. The base portion 14 may, for instance, be made from perforated material, netting, mesh or other fabric materials, for example of cotton, wool, or synthetic materials such as nylons, polyesters or the like.

The upper region 26 has a pair of glove compartments 32 to receive an item of arm and/or hand sports gear, such as a glove. A head gear compartment 34 is positioned between the glove compartments 32 to receive an item of head gear such as a helmet.

A shoulder pad storage location 36 is adjacent the head gear compartment 34 to receive a set of shoulder pads. In this case, the shoulder pad storage location 36 includes a pair of first strap portions 38 positioned adjacent the head gear compartment 34 and a first buckle arrangement 40 operable to join the first strap portions 38 together.

The central region 28 has a pair of elbow pad compartments 42 to receive a pair of elbow pads and a sports pant storage location 44 to receive a pair of sports pants. In this case, the sports pant storage location 44 includes a pair of second strap portions 46 and a second buckle arrangement 48 operable to join the second strap portions 46 together. A pair of foot gear compartments 50 is also provided to receive a pair foot gear, such as skates. A centrally located athletic support compartment 52 is also provided to receive an athletic support.

The lower region 30 includes at least one leg support gear compartment 54 to receive a plurality of leg support gear to support a leg or a portion thereof.

A pair of outer sock support locations is provided at 56 for supporting a pair of sport socks. In this case, each outer support location 56 includes a sock support loop 58 anchored to a corresponding peripheral support portion 20.

As can be seen in FIG. 2, the base portion 14 further includes an elongate central support portion 60 extending along a central region of the base portion 14 and aligned with and secured to the first and second strap portions 38, 46. In this case, the elongate central support portion 60 is a central support strap 61 stitched to the base portion 14.

The foldable panel 12 includes a pair of upper corners 62 and a pair of lower corners 64. The anchor portions 24 include a pair of loop portions 66, each located at a corresponding upper corner 62 for securing to a wall support member on the form of a wall support hook 68. In addition, a central loop portion 70 is integrally formed with the central support strap 61 also for securing to a wall support hook 68 to enhance the support of the device 10.

The upper and lower corners 62, 64 further include mating attachment portions 72 for joining one upper corner 62 of the foldable panel 12 with a corresponding lower corner 64. Desirably, the mating attachments portions 72 include buckle arrangements 74, but may instead including any number of other alternative arrangements, such as twist ties, hook and loop fasteners, buttons, snaps, clasps and the like.

Thus, for the device 10 to be configured for ice hockey, the compartments and support locations may be conveniently arranged with one or more of a pair of compartments to receive a hockey glove, a helmet, a set of shoulder pads, a pair of shin pads, a pair of skates, a pair of hockey pants, a pair of elbow pads and, if desired, and one or more compartments to receive other hockey accessories.

Each compartment may be provided with one or more fasteners shown at 76 to secure an item of apparel in one or more of the compartments when the foldable panel 12 is in the folded closed arrangement. In one example, the fastener may hook and loop fasteners of the variety known by the well known trademark Velcro®, but may include a range of other fasteners such as straps with buttons, clasps, buckles and the like. Alternatively or in combination, the at least one fastener may include a retractable opening to said at least one compartment, such as an opening with a peripheral region which contains an elastic band, a tie strap or a Velcro® strap to draw the peripheral region toward a constricted position.

In addition, one or more of the compartments may be provided with removable padding, shown schematically in dashed lines at 77 to provide protection either to the apparel item or to the user of the device 10.

The device is 10 particularly suited to the sport of ice-hockey because of the bulky nature of ice-hockey equipment, but may also be suited to arrange for other sports such as lacrosse, soccer, base ball, curling, football and the like.

A particular feature of the device 10 is the ability for the apparel stored therein to be conditioned. The term conditioned in this context includes washing, dry-cleaning, air drying or spraying with fabric freshener or the like or any other treatment that results in the apparel to be ready for another use. The foldable panel and compartments are thus configured to enable this conditioning to occur. This is achieved by selecting a material for the foldable panel 12 and the compartment which have a sufficient number of open passages, as may be conveniently provided by perforated or a "meshed" materials of plastics materials, such as nylon or propylene, cotton, rayon burlap or the like.

The foldable panel 12 provides a meshed material of plastics materials for durability and has a periphery which is bordered by a band of support material. A number of other straps and loops may be provided, such as the carry loops extending from opposite ends of the panel, a support loop for suspending the panel against a wall in the conditioning orientation, support loops for supporting socks and other similar apparel items, and fastening straps for holding the panel in its folded orientation.

It may be desirable for the length L to be selected to fit between the wall support hooks 68 and a change room bench 78 so that the foldable le panel 12 is not "draped" on the bench to interfere with the use of the bench 78 by a sports player. For example, it may be desirable for the length of the foldable panel 12 to be between about 40 and about 80 inches, more preferably between about 40 to about 60 inches, more preferably about 50 to about 60 inches and still more preferably between about 53 and about 56 inches. These specific dimensions may not, of course, suit all possible applications. Moreover, there may be some cases in which some "draping" of the foldable panel on the bench 78 may not be deemed as a problem, in which case the length L need not necessarily be limited to these approximate length ranges.

Figure 3:
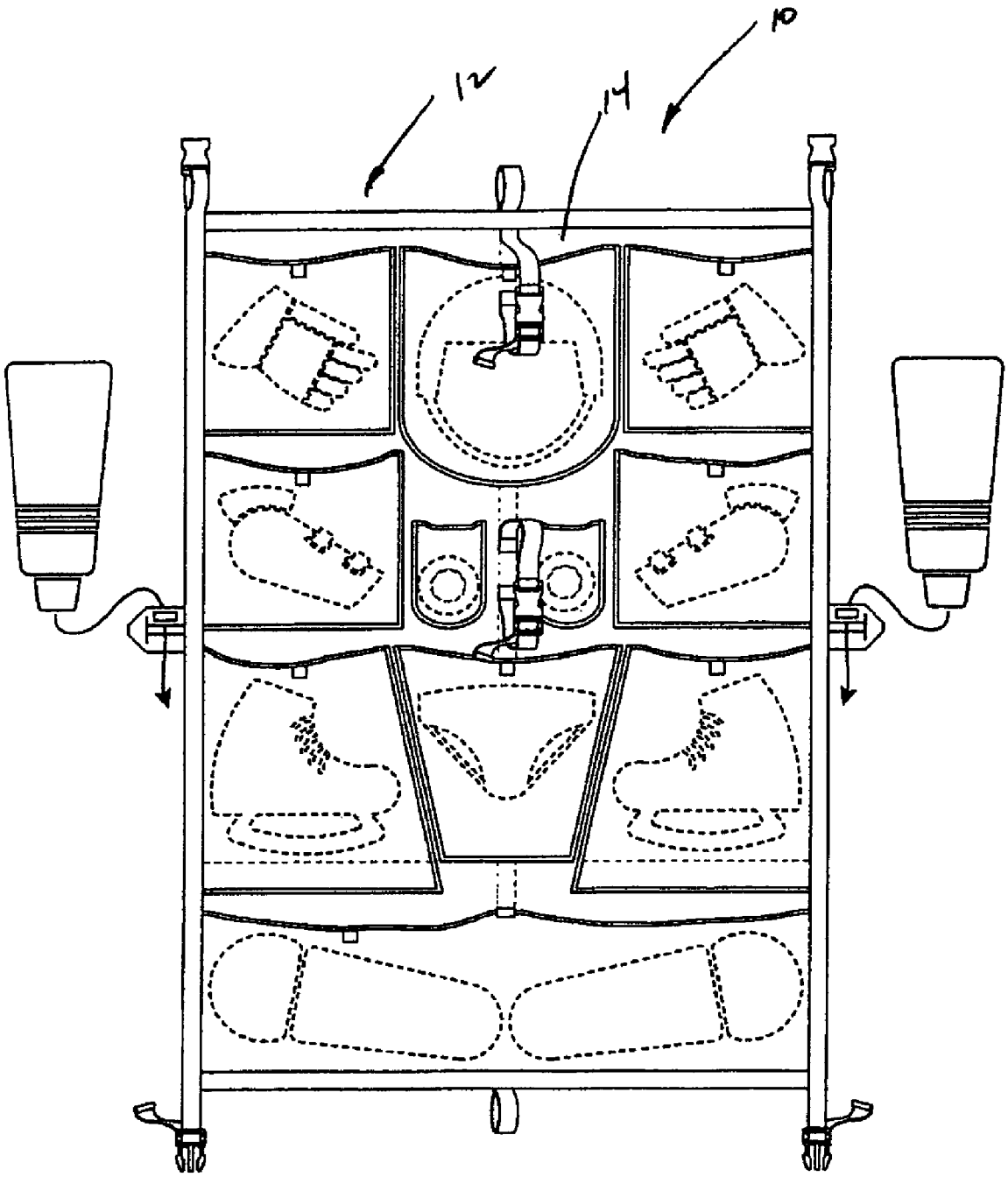
FIGS. 3 and 4 is a front view of the device in two operative conditions.
Figure 4:
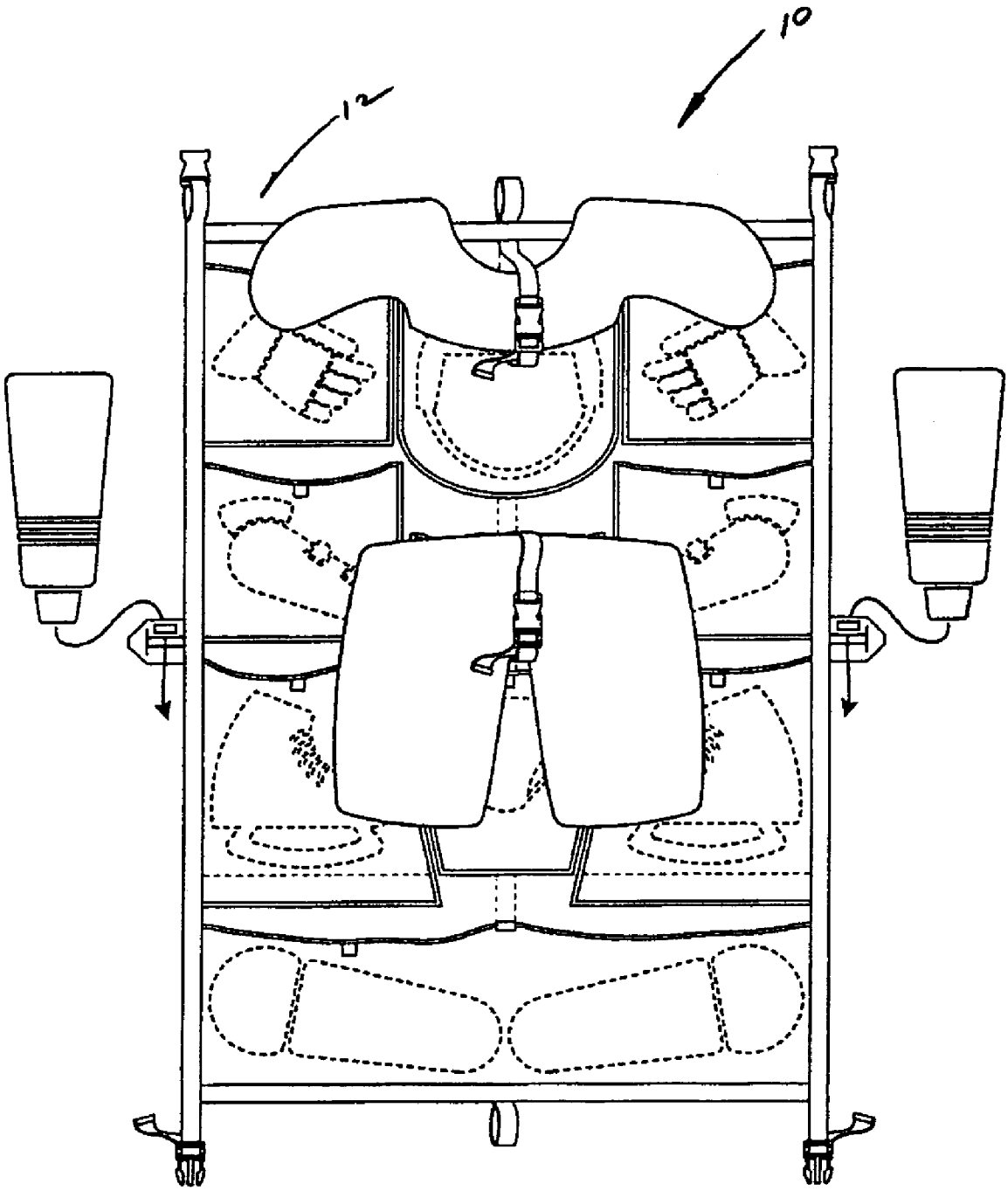
Figure 5:
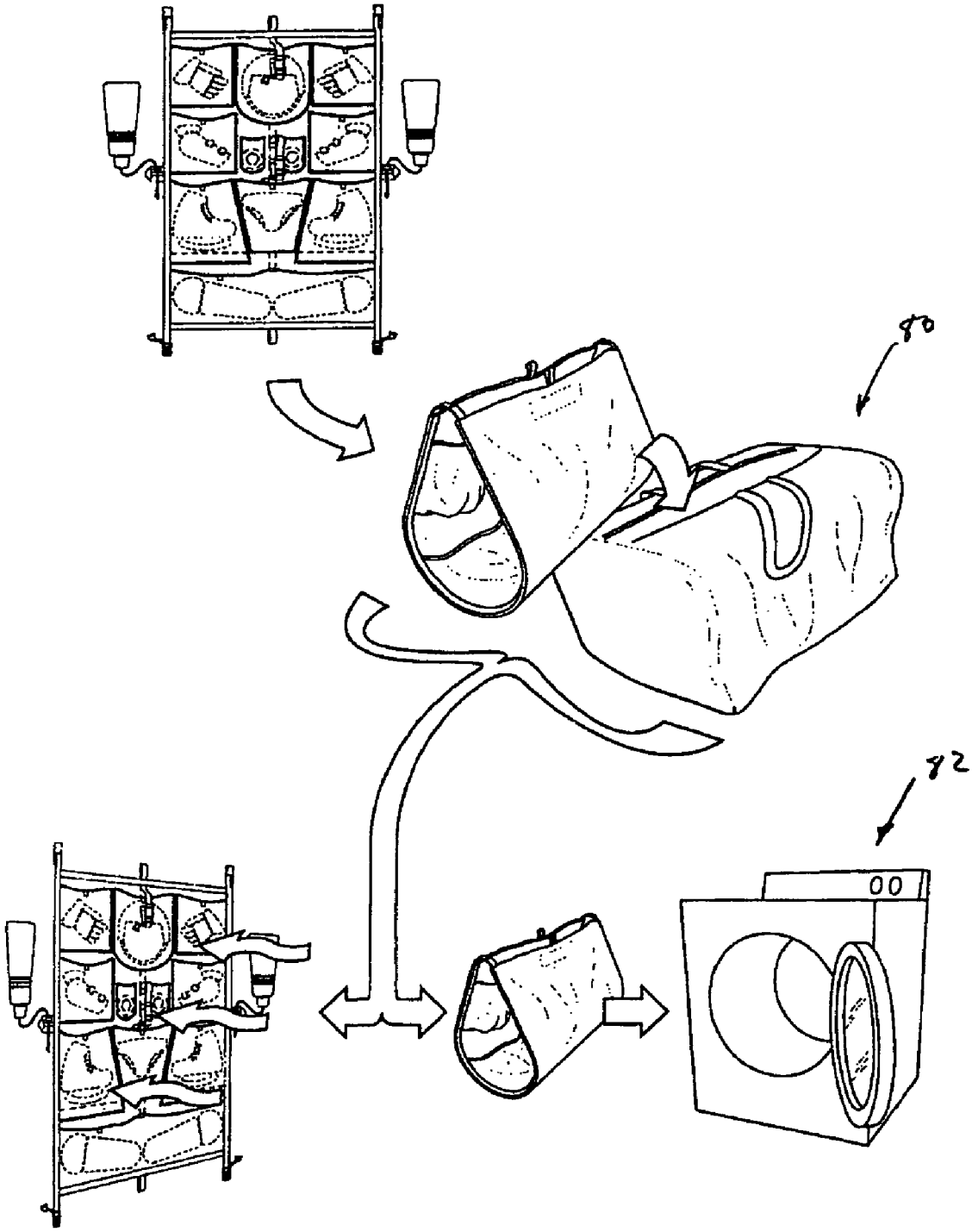
FIG. 5 is a perspective flow diagram of the device in another operative condition.

With reference to FIGS. 3 to 5, the device 10 may be used as follows. First, the foldable panel 12 is suspended from a vertical surface at a sports venue. Next, the various pieces of unconditioned, for instance used and wet, sports equipment are placed in the compartments and support locations after a sports event. In one or more of the compartments, the equipment may be retained therein by the use of the fastener 76 as may be provided. Referring to FIG. 4, the first and second strap portions 38, 46 may be wrapped around the shoulder pads and hockey pants respectively, while the socks are placed through the sock support loops 58. The device 10 may then be in a conditioning orientation for a sufficient period of time to condition the at least one item of sports apparel. This might involve simply leaving the equipment in the compartments in the changing room following the sports event. Alternatively, it may involve folding the panel and securing it in its folded orientation while transporting it home as it is or conveniently placed in a sports bag 80 as shown in FIG. 5 where the device may be hung vertically or left open in an inclined orientation. Still further, the device may be left in a folded orientation if proper and sufficient exposure is provided to the panel and compartment to allow the equipment to dry. If desired, the device may also be arranged to be placed in a dryer with the equipment in place in the compartments and be left to dry, while still in the compartments, all without having to remove the equipment from the compartments. This may, in some cases, significantly improve the convenience of playing the sport, may save tune, and may reduce the risk of losing or misplacing equipment between games. Alternatively, the support loops and the carry loops may be interchangeable in their function. In other words the support loops may also be used as carry loops when in the folded orientation, and the carry loops may be used as support loops in the unfolded orientation.

The device 10 also provides compartments for the various articles of sports apparel in locations on the foldable panel, when upright, that approximate their operative position on the player's body. The head gear compartment is centrally located in the upper region with the glove compartments, shoulder pad support location and elbow pad compartments. In other words, those compartments and storage locations in the upper region contain the sports gear to be worn on a sport's player's upper torso region including the head and arms.

Meanwhile, the central and lower region has the compartments to carry the sports gear to be worn on the sports player's lower torso including the legs and feet. This provides an additional benefit of providing an additional degree of organization.

Figure 6:
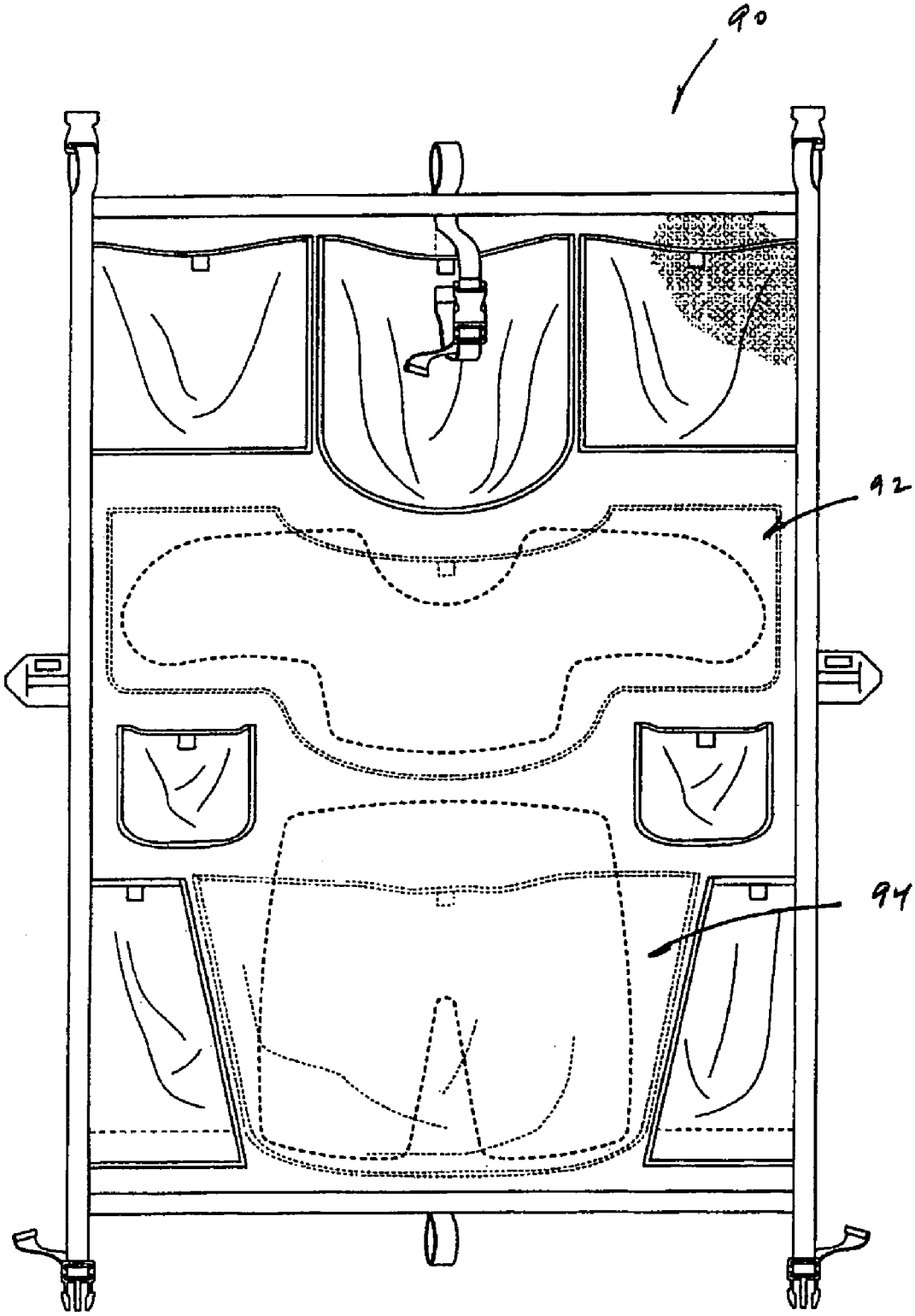
FIGS. 6 through 9 are front views of alternative storage devices.
Figure 7:
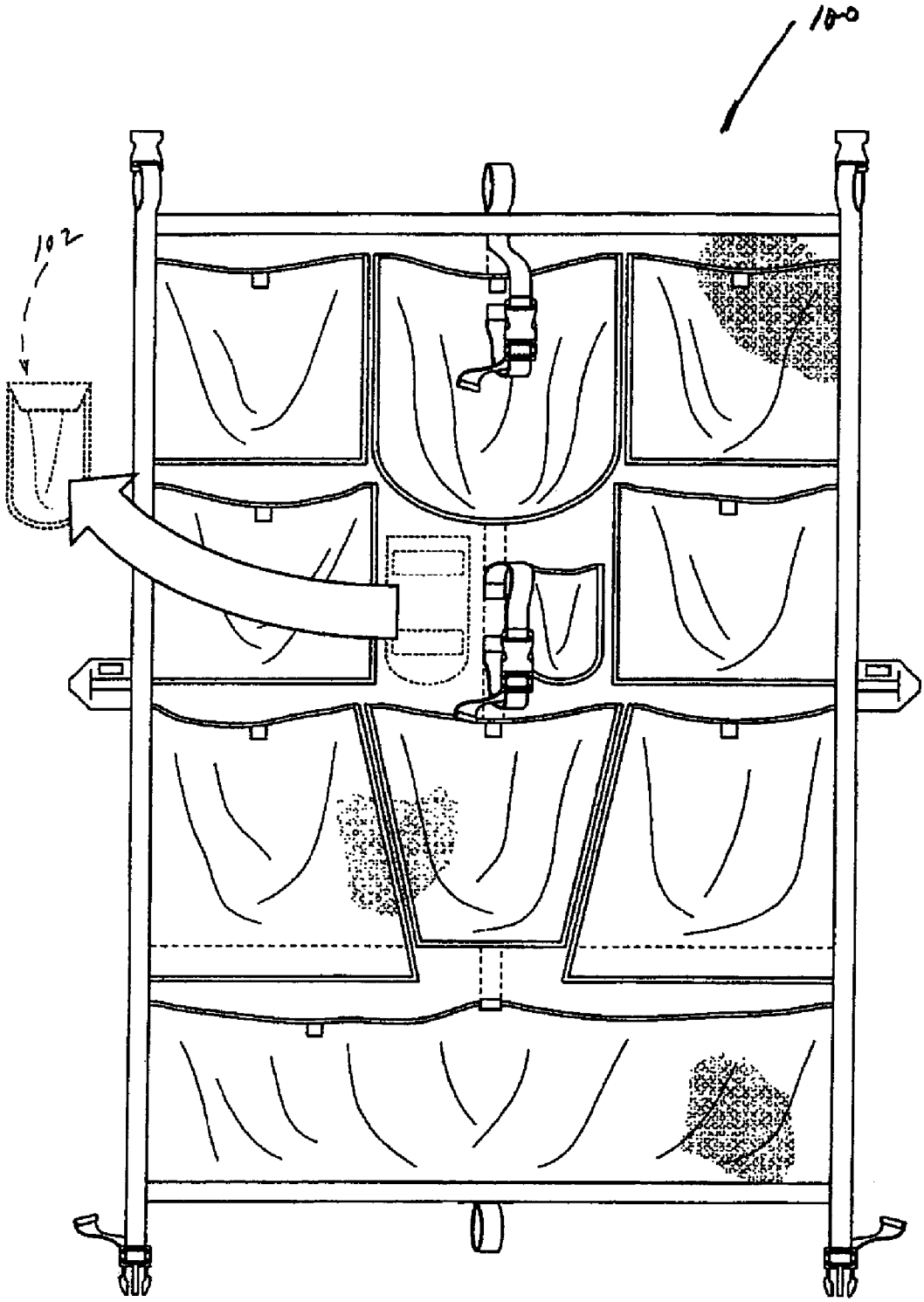

FIG. 6 shows another device 90 in which a shoulder pad compartment is provided at 92 to receive a pair of shoulder pads. A sports pant compartment is provided at 94 to receive a pair of sports pants. FIG. 7 shows another device at 100 which is provided with a removable, in this case centrally located, compartment 102 to receive accessories such as shower accessories to accompany the sports participant to the shower while leaving the device 100 into the change room. Of course, the removable compartment may be in various locations on the device 100 as desired. Others of the compartment and/or support locations in the device 100 and the earlier devices discussed herein may be movable or removable as desired.

Figure 8:
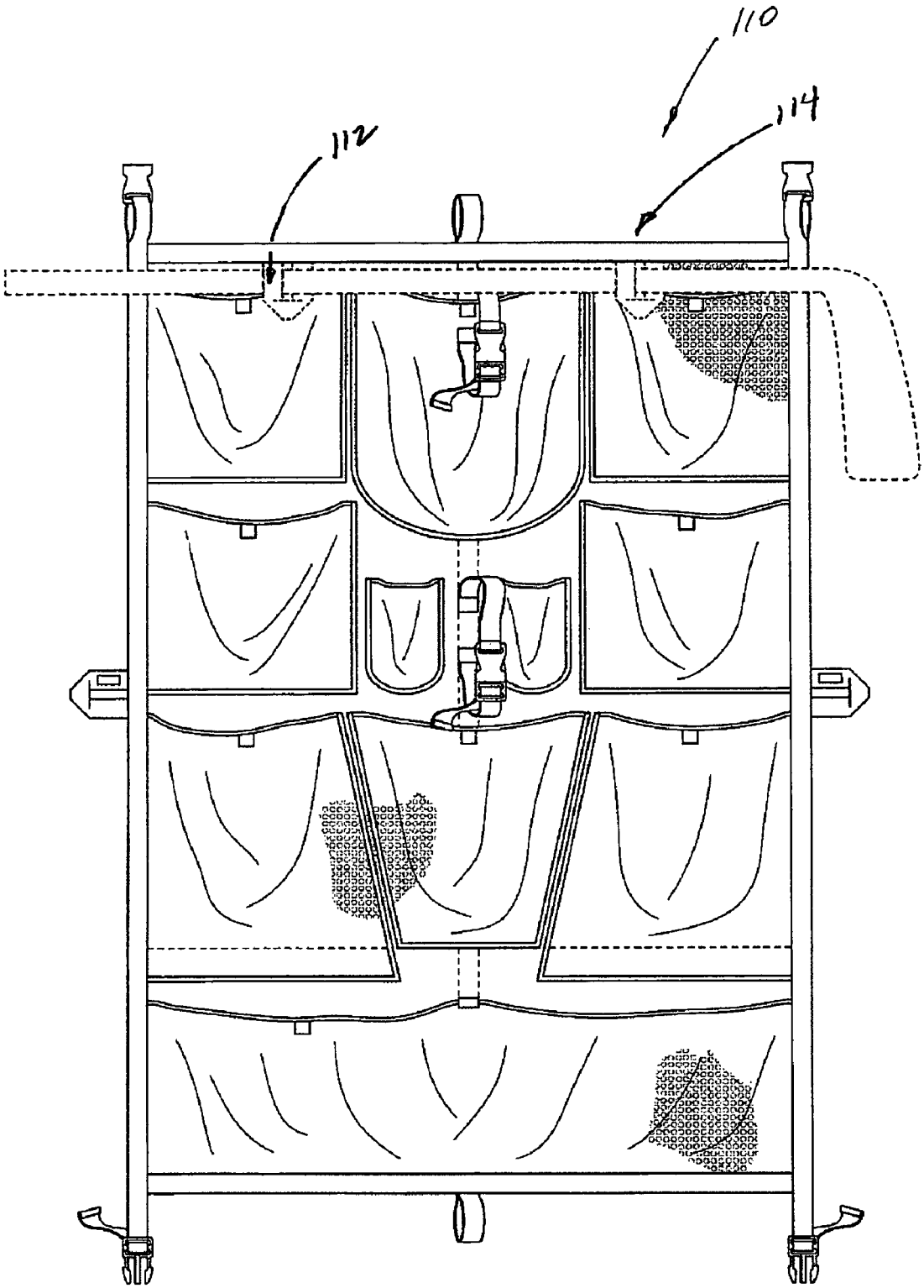
Figure 9:
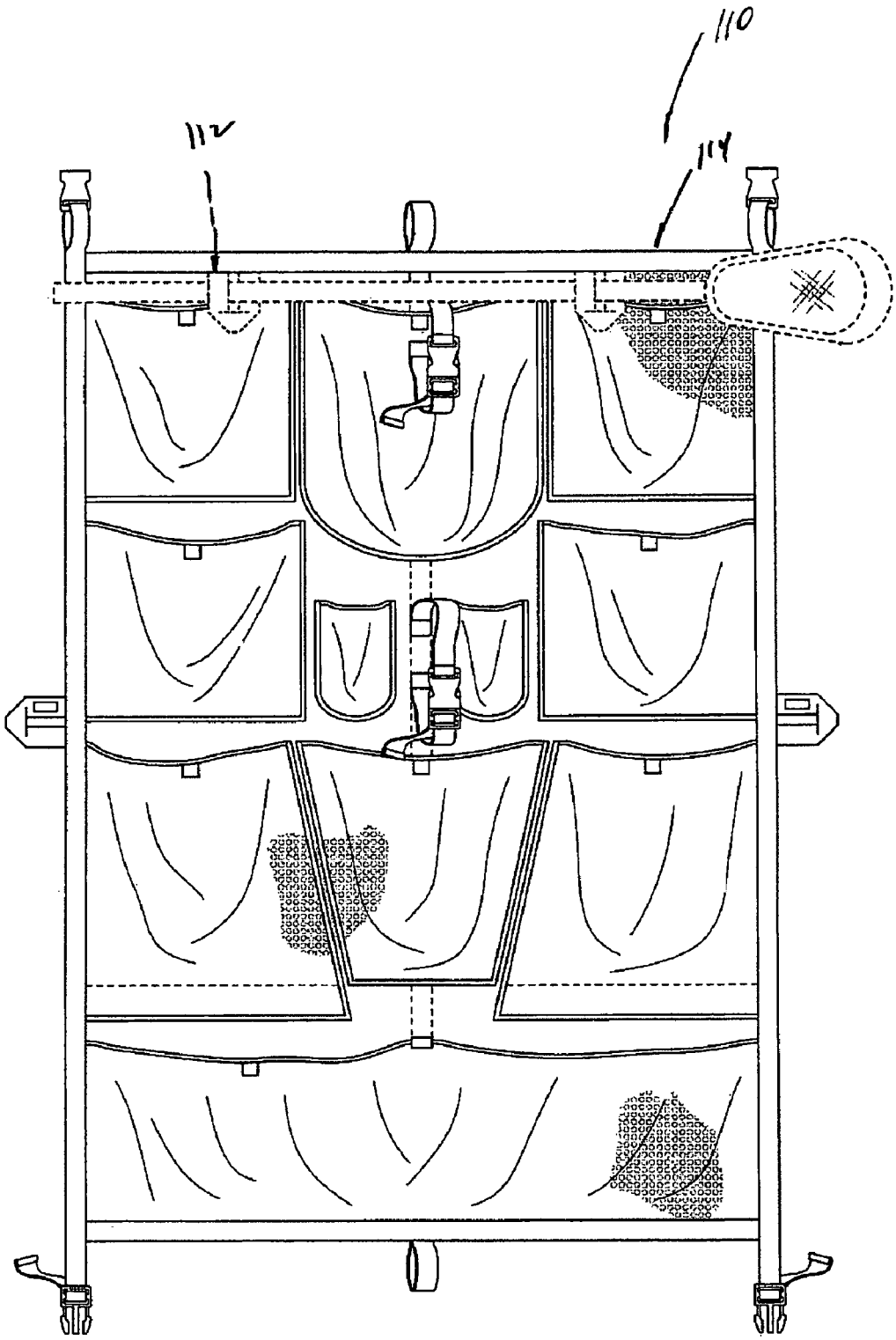

FIGS. 8 and 9 shows still other devices 110 which are equipped with additional support loops 112 along an upper peripheral 114 region to carry a sports game piece such as a hockey stick, lacrosse stick, baseball bat, curling broom and the like.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A device for holding and drying sports apparel comprising a foldable panel being convertible between an unfolded open arrangement or a folded closed arrangement, the foldable panel having a base portion with a peripheral region, a peripheral support portion attached thereto along substantially the entire peripheral region, the base portion having a plurality of anchor portions for supporting the base portion in an upright configuration to provide the base portion with an upper region, a central region and a lower region, the upper region including a pair of hand sports gear compartments, each to receive an item of hand sports gear, a head gear compartment between the hand sports gear compartments to receive an item of head gear, the upper region further including an upper arm sports gear storage location adjacent the head gear compartment to receive an item of upper arm sports gear; the upper arm sports gear storage location including a pair of first strap portions positioned adjacent the head gear compartment and a buckle arrangement operable to join the first strap portions together; the central region including a pair of lower arm sports gear compartments, each to receive an item of lower arm sports gear and a sports pant storage location to receive a pair of sports pants, the sports pant storage location including a pair of second strap portions and a buckle arrangement operable to join the second strap portions together; a pair of foot gear compartments, each to receive an item of foot sports gear, an athletic support compartment to receive an athletic support; the lower region including at least one compartment to receive a plurality of items of leg support gear, the base portion providing a matrix of open drying spaces along substantially its entire length and the compartments providing a matrix of open drying spaces for exposing the sports apparel to ambient air flow for drying thereof; a pair of outer sock support locations for supporting a pair of sport socks, each outer support location including a sock support loop anchored to a corresponding peripheral support portion; the foldable panel further including an elongate support portion extending along a central region of the base portion and aligned with the first and second strap portions.

2. A device as defined in claim 1, wherein the elongate support portion includes a central support strap which is secured to the first and second strap portions.

3. A device as defined in claim 2, further comprising a central loop portion integrally formed with the central support strap.

4. A device as defined in claim 2, wherein the foldable panel includes a pair of upper corners and a pair of lower corners, the anchor portions including a pair of loop portions, each located at a corresponding upper corner for securing to a wall support member.

5. A device as defined in claim 4, wherein the upper and lower corners further comprise mating attachment portions for joining one upper corner of the foldable panel with a corresponding lower corner.

6. A device as defined in claim 5, wherein the attachment portions include buckle arrangements.

* * * * *